US005605510A

United States Patent [19]

Schmidt et al.

[11] Patent Number: 5,605,510

[45] **Date of Patent: *Feb. 25, 1997**

[54] GOLF PUTTER WITH FACE PLATE INSERT

[75] Inventors: Glenn H. Schmidt, Malibu; Richard C. Helmstetter, Carlsbad, both of Calif.

[73] Assignee: Callaway Golf Company, Carlsbad, Calif.

[ * ] Notice: The term of this patent shall not extend beyond the expiration date of Pat. No. 5,460,377.

[21] Appl. No.: 440,936

[22] Filed: May 15, 1995

Related U.S. Application Data

[63] Continuation of Ser. No. 286,275, Aug. 5, 1994, Pat. No. 5,460,377, which is a continuation of Ser. No. 161,592, Dec. 6, 1993, abandoned, which is a continuation of Ser. No. 999,249, Jan. 19, 1993, abandoned, which is a continuation-in-part of Ser. No. 921,857, Aug. 5, 1992, Pat. No. 5,282,625.

[51] Int. Cl.[6] ..... A63B 53/04

[52] U.S. Cl. ..... 473/251; 473/313; 473/340; 473/342

[58] Field of Search ..... 473/324, 330, 473/332, 340, 341, 349, 350, 347, 251, 290, 291, 328, 313; D21/217

[56] References Cited

U.S. PATENT DOCUMENTS

| | | |
|---|---|---|
| D. 196,734 | 10/1963 | Solheim . |
| D. 223,767 | 6/1972 | Houghtaling . |
| D. 228,355 | 9/1973 | Penna . |
| D. 234,209 | 1/1975 | Bizovi . |
| D. 234,963 | 4/1975 | Hirata . |
| D. 238,285 | 12/1975 | Ross . |
| D. 245,441 | 8/1977 | Middlestadt . |
| D. 247,383 | 2/1978 | Adkins . |
| D. 248,181 | 6/1978 | Cervantes . |
| D. 257,784 | 1/1981 | Forys et al. . |
| D. 303,132 | 8/1989 | Muta . |
| D. 321,920 | 11/1991 | Parente et al. . |
| 922,444 | 5/1909 | Youds . |
| 1,485,685 | 3/1924 | McMahon . |
| 1,511,479 | 10/1924 | Kelly et al. . |
| 1,517,476 | 12/1924 | Tyler . |
| 1,678,637 | 7/1928 | Drevitson . |
| 1,854,548 | 4/1932 | Hunt . |
| 1,993,928 | 3/1935 | Glover . |
| 2,231,847 | 2/1941 | Dickson et al. . |
| 2,661,952 | 12/1953 | Jackson . |
| 2,781,197 | 2/1957 | Wiley . |
| 3,043,596 | 7/1962 | Ehmke . |
| 3,068,011 | 12/1962 | Sano . |
| 3,134,596 | 5/1964 | Boznos . |
| 3,199,872 | 8/1965 | Taylor . |
| 3,211,455 | 10/1965 | Hyden . |
| 3,218,072 | 11/1965 | Burr . |

(List continued on next page.)

FOREIGN PATENT DOCUMENTS

| | | |
|---|---|---|
| 371974 | 5/1932 | United Kingdom . |

OTHER PUBLICATIONS

"Some of Our Best Friends are Hookers and Pushers", *Golf World*, Jan. 1974, p. 45.

"The Ounce That Counts", *Golf World*, Jan. 24, 1975, pp. 46 & 47.

"Stroke–Savers", *Golf Digest*, Mar. 1988, pp. 82 & 83.

"FTD Iron by First Flight", *Golf World*, May 23, 1972, p. 10.

"The Wilson Staff Dynapower Iron", *Time Magazine*, Mar. 24, 1967, p. 1.

"T. P. Super Blade", *Golf World*, Jun. 13, 1972, p. 25.

*Primary Examiner*—Sebastiano Passaniti

*Attorney, Agent, or Firm*—William W. Haefliger

[57] ABSTRACT

A golf putter for use with a putter shaft supporting a head, the head comprising a putter body having a heel, toe, and sole defining a bottom wall, and a front wall, the body elongated between the heel and toe, and; the body having at least one recess projecting forwardly toward a plane defined by the front wall; and the body having a second recess sunk in the front wall, there being a non-metallic face plate having a periphery received in the second recess and bonded to the body.

12 Claims, 2 Drawing Sheets

U.S. PATENT DOCUMENTS 3,240,497 3/1966 Taylor .
3,333,854 8/1967 White .
3,387,844 6/1968 Shippee .
3,680,868 8/1972 Jacob .
3,815,910 6/1974 Raines .
3,843,122 10/1974 Florian .
3,847,399 11/1974 Raymond .
3,888,492 6/1975 Cabot .
3,928,113 12/1975 Rosenberg .
4,000,902 1/1977 Perkins .
4,113,249 9/1978 Berry .
4,121,832 10/1978 Ebbing .
4,199,144 4/1980 Skelly .
4,252,262 2/1981 Igarashi .
4,330,128 5/1982 Morelli .
4,398,965 8/1983 Campau .
4,484,746 11/1984 Brill .
4,573,685 3/1986 Young, IV et al. .
4,596,260 6/1986 Giuliano .
4,626,428 12/1986 Weisberg .
4,632,400 12/1986 Boone .
4,653,756 3/1987 Sata .
4,679,792 7/1987 Straza et al. .
4,682,612 7/1987 Giuliano .
4,695,054 9/1987 Tunstall .
4,715,601 12/1987 Lamanna .
4,848,747 7/1989 Fujimura et al. .
4,854,581 8/1989 Long .
4,869,507 9/1989 Sahm .
4,884,812 12/1989 Nagasaki et al. .
4,913,435 4/1990 Kobayashi .
4,928,972 5/1990 Nakanishi et al. .
4,957,294 9/1990 Long .
4,960,279 10/1990 Harris, Jr. .
4,964,640 10/1990 Nakanishi et al. .
4,986,541 1/1991 Teramoto et al. .
4,995,609 2/1991 Parente et al. .
5,016,882 5/1991 Fujimura .
5,026,056 6/1991 McNally et al. .
5,046,733 9/1991 Antonious .
5,067,711 11/1991 Parente et al. .
5,078,398 1/1992 Reed et al. .
5,083,778 1/1992 Douglass .
5,154,425 10/1992 Niskanen et al. .
5,176,384 1/1993 Sata .
5,197,737 3/1993 Desbiolles et al. .
5,332,223 7/1994 Johnson .

GOLF PUTTER WITH FACE PLATE INSERT

This is a continuation patent application of Ser. No. 08/286,275 filed Aug. 5, 1994, now U.S. Pat. No. 5,460,377, which is a continuation of Ser. No. 08/161,592 filed Dec. 6, 1993, (now abandoned), which is a continuation of Ser. No. 07/999,249 filed Jan. 19, 1993, (now abandoned), which is a continuation-in-part of Ser. No. 07/921,857 filed Aug. 5, 1992, now U.S. Pat. No. 5,282,625.

BACKGROUND OF THE INVENTION

This invention relates generally to golf putters, and more particularly to enhancing putter stability when the putter is maneuvered to address and stroke a golf ball on a golf green.

It is commonly found that golf putters tend to twist in response to their placement downwardly on a green in ball addressing position. Such twisting results in mis-alignment of the putter front face relative to the ball, and requires one or more re-alignment adjustments. Putters can also twist during back-swing away from the ball, and forward striking toward and with the ball, one cause of such twisting being putter bottom surface variable engagement with the turf during such swinging and stroking.

There is need for improved means to reduce or eliminate these mis-alignment effects, as referred to, as well as need to improve the overall performance of golf putters.

SUMMARY OF THE INVENTION

It is a major object of the invention to provide an improved putter head so constructed as to reduce or eliminate the mis-alignment problem as referred to.

Basically, the improved putter of the present invention comprises, in combination:

a) a putter body having a heel, toe, and sole defining a bottom wall, and a ball striking front face, the body elongated between the heel and toe, and b) the body having at least one recess projecting forwardly toward a plane defined by the front wall, c) and the body having a second recess sunk in the front wall, there being a non-metallic face plate having a periphery received in the second recess and bonded to the body.

It is another object to provide a control rail projecting downwardly from the bottom wall, the rail being elongated in a direction between the heel and toe to engage the turf as the putter is placed downwardly on a golf green, and in a manner to stabilize the head against twist during the head downward placement. As will be seen, the rail is typically spaced rearwardly from the front face defined by the non-metallic front face along the major length of the rail. The rail also has a narrow bottom surface along its length, that surface being flat in front to rear direction widthwise of the rail. The rail bottom surface has substantially uniform width along the majority of the rail length, the rail extending lengthwise below the middle of the putter body between the heel and toe, and below the non-metallic face plate. The rail weight adds to anti-twist peripheral weighting marked by use of the non-metallic face plate.

It is another object of the invention to provide the control rail with a frontward facing surface which tapers downwardly and rearwardly to merge with forward extent of the rail bottom surface; and the rail also has a rearward facing surface which tapers downwardly and forwardly to merge with rearward extent of the rail hollow surface. Such surfaces engage the turf in such manner, during head stroking, to result in forces tending to elevate the head to prevent digging of the putter into the turf; and such surfaces typically extend equidistantly toward the toe and heel, from the said region of the head and rail, so that twisting forces due to turf engagement are counter balanced.

Yet another object is to provide a rail as referred to, which is curved, i.e., extends in a curved plane along the rail length, thereby to provide turf engaging rail support points that are not all in a line, so that stability against tilt of the head results from rail biting into the turf as the head is placed downwardly in position, addressing the ball.

These and other objects and advantages of the invention, as well as the details of an illustrative embodiment, will be more fully understood from the following specification and drawings, in which:

DRAWING DESCRIPTION

DETAILED DESCRIPTION

Figure 1:
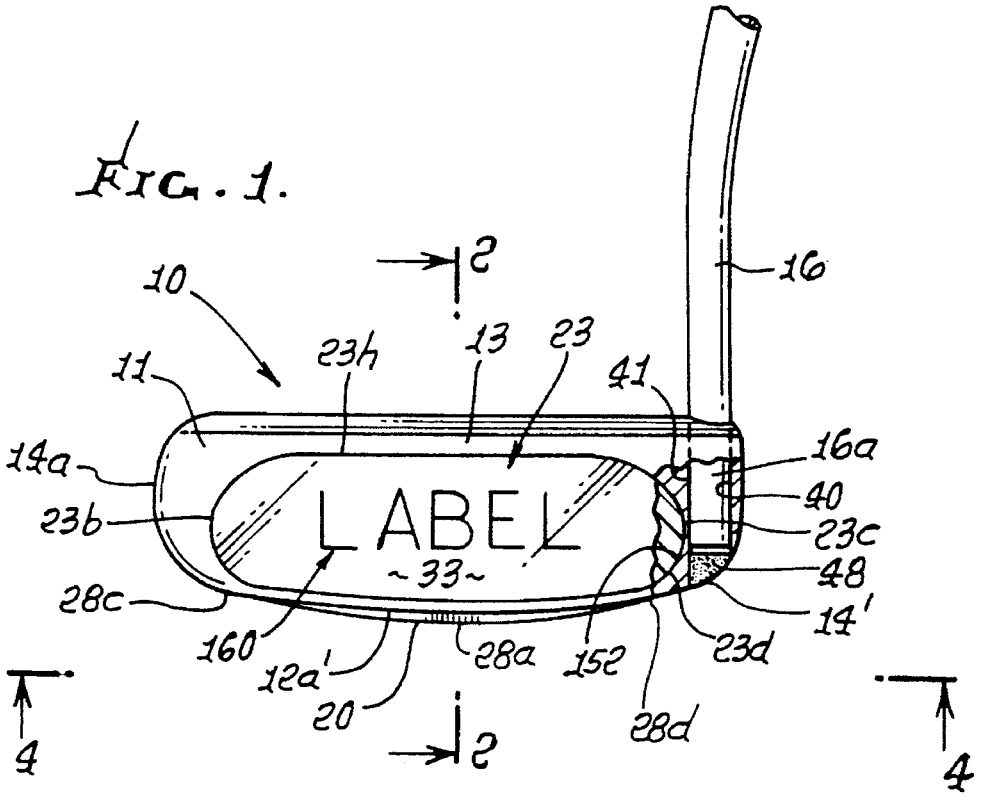
FIG. 1 is a frontal elevation showing a putter head incorporating the invention.

In FIGS. 1–4 of the drawings, the putter head 10 has a body 11 defining a sole 12, front ball striking face or surface 13, heel 14, and toe 14*a*. A shaft 16 is connected to the body and extends upwardly, as shown. The head may be metallic, and typically consists of brass. The body is elongated between the heel and toe, as shown.

Figure 2:
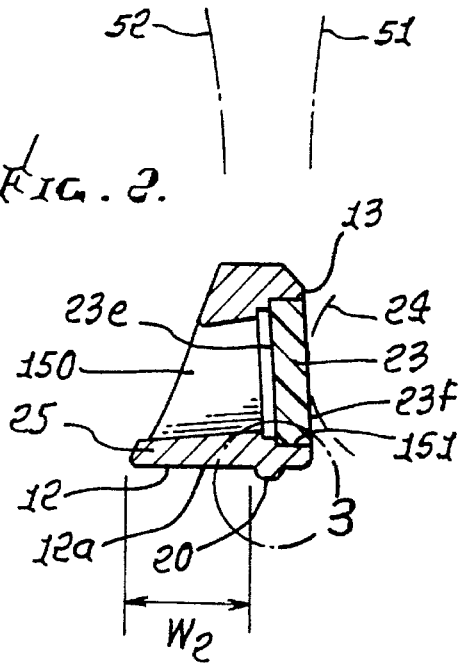
FIG. 2 is a section taken on lines 2—2 of FIG. 1.
Figure 3:
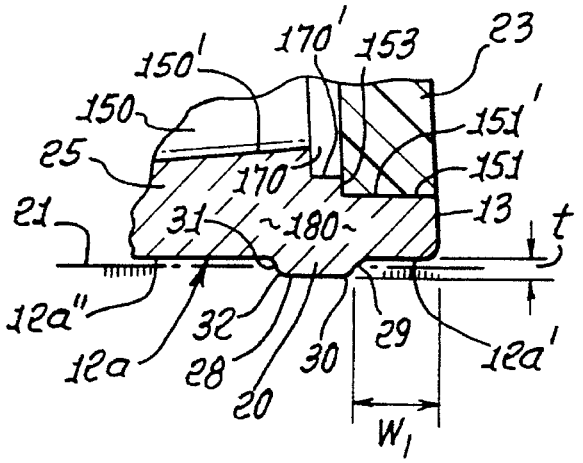
FIG. 3 is an enlarged fragmentary section, taken on lines 3—3 of FIG. 2.

In accordance with one aspect of the invention, a rail 20 projects downwardly from the bottom wall 12*a* of the sole, the rail 20 being elongated in a direction between the heel and toe to engage the turf 21 of the putting green and projects downwardly into the turf, as shown in FIG. 3, in a manner to stabilize the head for resisting twist as in either or both twist directions (indicated by arrows 22 and 22*a* in FIG. 4) as the putter sole is placed downwardly, on the green turf. See also the golf ball 24 in FIG. 2, in front of face 13, the rail received in the turf tending to maintain the head face 13 squared relative to the ball, Just prior to stroking of the head by manual swing of the shaft 16. See FIG. 3.

As shown, the elongated rail is spaced rearwardly from the front face 13, beneath the upright head front plate 23, for substantially balanced support of the head. The head has a bottom and rearward flange 25 projecting rearwardly from lower extent of body 11, to define the sole bottom wall 12*a*, as seen in FIG. 3. The bottom wall includes bottom wall extent 12*a*' frontwardly of the rail, and bottom wall extent 12*a*" rearwardly of the rail. In the example, the front-to-rear width $w_1$, of 12*a*' is substantially less than the front-to-rear width $w_2$ of 12*a*" and typically, $w_2$, is two to six times $w_1$. Bottom wall extent 12*a*' is typically flat in a front-to-rear direction, and shallowly downwardly convex in a heel-to-toe direction (see FIG. 1); and bottom wall extent 12*a*" is also shallowly downwardly convex, similar to 12*a*', as in FIG. 1.

Rail 20 has a bottom surface 28 extending along the rail length, that surface typically having constant, or substantially constant width, and being flat or substantially flat in a front to rear direction, widthwise of the rail. Such width should be between ⅛ and ⅜ inches, and the rail should project below the sole surface by an amount "t" where t decreases toward the toe, and also decreases toward the heel, from a mid-point 28*a*, along the rail length (see FIG. 1). The maximum amount "t" should be between 1/16 and ⅛ inch, so as to effectively seat into the green turf at the mid region of the head, without extending too deeply into the turf so as to impede head stroking. Rail bottom surface 28 has greater curvature, than the curvature of sole 12 in a toe to heel direction to merge with the sole at 28*c* and 28*d*.

Further, the rail 20 has frontwardly facing surface 29 which tapers downwardly and rearwardly (see FIG. 3) so as to slide over the turf as the head is stroked, the impact of the turf against the tapered surface 29 tending to lift the putter head and prevent or minimize digging of the head further into the turf as the head is stroked. Surface 29 merges with surface 28 along a rounded edge 30, to enhance these effects.

Likewise, the rail 20 has a rearwardly facing surface 31 which tapers downwardly and forwardly (see FIG. 3) to merge with surface 28 along a rounded edge 32. Surfaces 31 and 32 enable rearward sliding of the putter over the green turf as the head is swung backwardly relative to the golf ball, tending to prevent or minimize digging of the head into the turf during the back-stroke.

Note that the rail middle extent extends lengthwise below the middle of the putter, i.e., the "sweet spot" region 32 of plate 23 directly rearwardly of the ball; also, the rail extends from that middle extent toward the heel and toward the toe to equal, or substantially equal extents, whereby rail engagement with the turf during the back and forward strokes is the same toward the toe and toward the heel (from the rail middle extent) to minimize twisting of the putter head as it is stroked.

Figure 4:
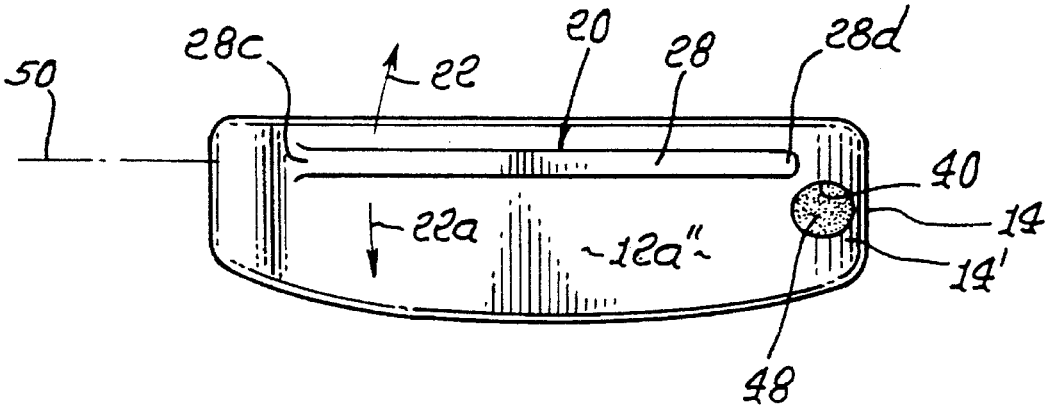
FIG. 4 is a bottom plan view taken on lines 4—4 of FIG. 1.

In FIGS. 1, 2 and 4, the putter shaft 16 is affixed to the body 11 to project downwardly between heel 14 and the arcuate heel end 23*c* of plate 23. The body 11 defines or contains a shaft receiving bore 40 wherein the shaft lower end 16*a* is joined to the bore, as by adhesive, at 41. The bore intersects the bottom surface of the heel at 14', as seen in FIGS. 1 and 4; and the shaft end may also extend almost to the bottom surface between the heel and end 28*d* of the rail. Filler 48 fills space between the lower core of the shaft and the surfaces 12 and 28. Note that bore 40 extends upright and the shaft extends upwardly from that bore.

It will be noted that in FIGS. 1–4, the rail lengthwise extent defines a flat, upright plane 50 extending between the toe and heel, forwardly of the shaft bore 40. See FIG. 4. Such a straight rail allows some pivoting or tilting of the head forwardly or rearwardly, as indicated by lines 51 and 52 in FIG. 2. To eliminate or reduce such capacity for tilting, i.e., to help maintain the head in upright position as seen in FIG. 2, with face 13 squarely addressing the ball, the rail may be formed to be lengthwise curved, to provide enhanced support for the putter body on the turf, i.e., "3-point" support, in effect. See for example the curved plane 55 of the rail 56 in FIG. 5, and such curvature may take various forms. Three points of support, out of alignment, are seen at A, B and C, in FIG. 5. Such a rail 56, otherwise like the above described rail 20, provides all of the advantages of rail 20, plus the added, anti-pivot support for the putter body as described. Note that the front inclined surface of rail 56 has variable spacing from the ball-striking surface 113 of the putter head.

Figure 5:
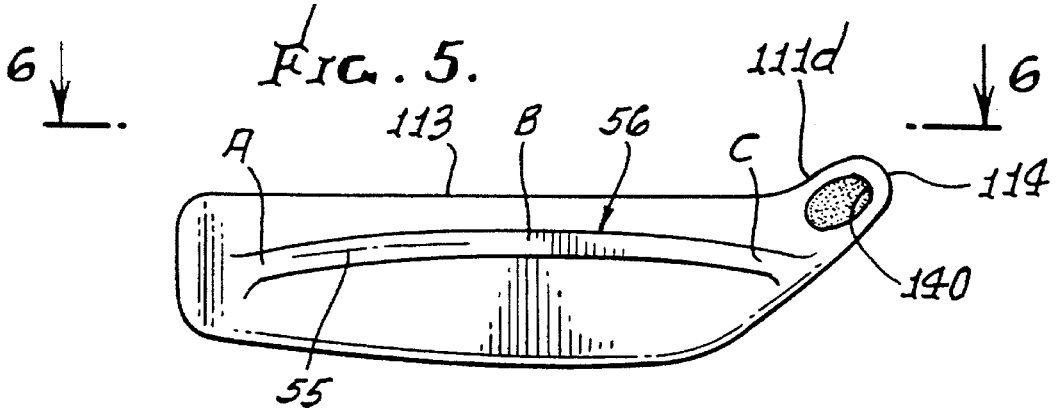
FIG. 5 is a view like FIG. 4, showing a modification.
Figure 6:
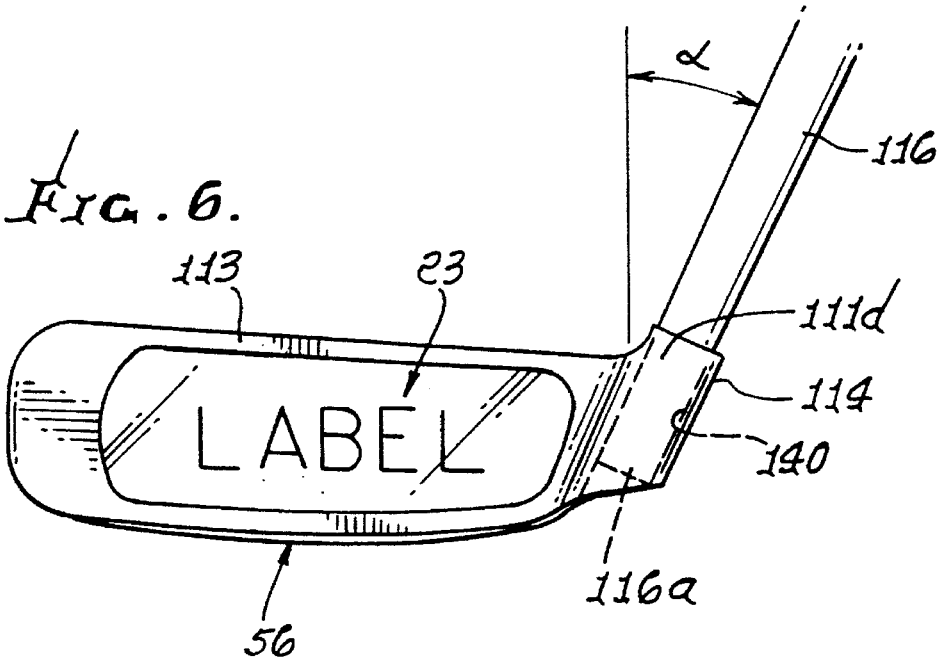
FIG. 6 is a front elevation taken on lines 6—6 of FIG. 5.

Note also in FIGS. 5 and 6 that the putter shaft 116 now extends at angle relative to vertical, where is between 10° and 30°; and that the shaft lowermost extent 116*a* is recessed in a correspondingly angled bore 140 in head forwardly offset extent 111*d* at the heel 114. Bore 140 is now forward of the curved plane 56, the latter being convex forwardly toward the plane of flat face 113, whereby turf is engaged by the convex forward edge of the rail, otherwise having sectional shape, as in FIG. 3, to slide or glide over the turf, which acts to urge the head upwardly out of the turf during a putting stroke.

Referring again to FIGS. 1–4, the putter body has at least one recess 150 projecting forwardly toward a plane defined by front wall or face 13. Recess 150 opens rearwardly, as seen in FIG. 2. The body also has a second recess 151 sunk in the front wall, and is sized to closely receive the periphery 23*d* of the plate 23, which is non-metallic. The periphery 23*d* may be bonded to the body inner wall 152 bounding recess 151. The plate seats against a body looping shoulder 153, facing forwardly at the bottom of recess 151. The rear side 23*e* of plate 23 openly faces shoulder 153; and the plate may be oval, as shown, with rounded, convex opposite ends 23*b* and 23*c*, and straight top wall 23*h*.

Face plate 23 typically consists of synthetic resin, and defines ball-striking surface 23*f*, forwardly of recess 151. Also, it has uniform thickness and is preferably substantially transparent, to present viewing of alpha-numeric characters 160 (the word "LABEL" being merely representative) identifying the golfer or manufacturer, or other entity. Characters 160 may define a monogram, internally of the plastic material and viewable from the front of the plate.

As shown in FIGS. 2 and 3, the body defines a third recess 170 sunk in the front wall, rearwardly of recess 151, and to a depth greater than that of 151. Recess 170 periphery intersects the first recess 150, as shown. The peripheries of the three recesses are stepped, as at 150', 151', and 170', as seen in FIG. 3, inwardly of the rail 20. Thus, ball impact force transmitted to the plastic face plate 23 is in turn transmitted to the metal body by the periphery of the face plate, in the plane of the rail, i.e., ball-striking forces on the plate 33; and turf forces on the rail, during stroking, are concentrated at lower region 180 of the head, where head forward momentum acts, for balance. Use of lightweight plastic for plate 23 also enables peripheral weight concentration of head metal, to resist twist of the head, during stroking.

We claim:

1. A golf club for use with a shaft supporting a head, the head comprising in combination:

a) a body having a heel, toe, and sole defining a bottom wall, and a front wall, the body elongated between the heel and toe, and b) the body having at least one recess originating from a rear portion of the body and projecting forwardly toward a plane defined by the front wall, c) the body having a second recess sunk in said front wall, there being a face plate which is non-metallic and having a periphery received in said second recess and bonded to said body, said plate having a forward surface and said second recess extending rearwardly from a plane defined by said plate, d) there being structure on the body forming a shaft-receiving bore spaced from each recess and from said face plate, e) the body having a third recess located between the first and second recesses, f) the third recess having a thickness and the face plate having a thickness, the face plate thickness exceeding the third recess thickness.

2. The combination of claim 1 wherein the face plate has a rearward side exposed rearwardly.

3. The combination of claim 1 wherein the face plate openly faces the second recess.

4. The combination of claim 1 wherein said face plate has a periphery, said periphery being convex toward the toe and convex toward the heel.

5. The combination of claim 4 wherein said body has an inner wall closely bounding said plate periphery which is convex toward the toe and convex toward the heel.

6. A golf club for use with a shaft supporting a head, the head comprising in combination a) a body having a heel, toe and sole defining a bottom wall, and a front wall, the body elongated between the heel and toe, and b) the body having at least one recess originating from a rear portion of the body and projecting forwardly toward a plane defined by the front wall, c) the body having a second recess sunk in said front wall, there being a face plate which is non-metallic and having a periphery received in said second recess and bonded to said body, said plate having a forward surface and said second recess extending rearwardly from a plane defined by said forward surface, d) there being structure on the body forming a shaft-receiving bore spaced from each recess and from said face plate, e) and including a rail projecting downwardly below said bottom wall below the level of the face plate.

7. A golf club for use with a shaft supporting a head, the head comprising in combination a) a body having a heel, toe and sole defining a bottom wall, and a front wall, the body elongated between the heel and toe, and b) the body having at least one recess originating from a rear portion of the body and projecting forwardly toward a plane defined by the front wall, c) the body having a second recess sunk in said front wall, there being a face plate which is non-metallic and having a periphery received in said second recess and bonded to said body, said plate having a forward surface and said second recess extending rearwardly from a plane defined by said plate, d) there being structure on the body forming a shaft-receiving bore spaced from each recess and from said face plate, e) the body having a third recess located between said first and second recesses, and peripherally stepped relative thereto, f) and wherein the face plate has a thickness and said third recess has a thickness, said face plate thickness exceeding the thickness of the third recess.

8. A golf club for use with a shaft supporting a head, the head comprising in combination:

a) a body having a heel, toe, and sole defining a bottom wall, and a front wall, the body elongated between the heel and toe, and b) the body having at least one recess originating from a rear portion of the body and projecting forwardly toward a plane defined by the front wall, c) the body having a second recess sunk in said front wall, there being a face plate and having a periphery received in said second recess and attached to said body, said plate having a forward surface and said second recess extending rearwardly from a plane defined by said forward surface, d) there being shaft support structure on the body spaced from each said recess and from said face plate, e) the body having a third recess located between portions of the first and second recesses, f) the third recess having a thickness and the face plate having a thickness the face plate thickness exceeding the third recess thickness.

9. The golf club of claim 8 wherein the third recess is stepped relative to the first and second recesses.

10. The golf club of claim 8 wherein the face plate has a rearward side exposed rearwardly.

11. The golf club of claim 8 which is a putter.

12. A golf putter for use with a putter shaft supporting a head, the head comprising, in combination:

a) a putter body having a heel, toe, and sole defining a bottom wall, and a front wall, the body elongated between the heel and toe, and b) the body having at least one recess originating from a rear portion of the putter body and protecting forwardly toward a plane defined by the front wall, c) the body having a second recess sunk in said front wall, there being a face plate having a periphery received in said second recess and attached to said body, said plate having a forward surface and said second recess extending rearwardly relative to a plane defined by said forward surface, d) and including putter shaft support structure on said body and spaced from each recess and from said face plate.

* * * * *